US005367780A

United States Patent [19]

Savage

[11] Patent Number: 5,367,780

[45] Date of Patent: Nov. 29, 1994

[54] ARCHERY BOW TORQUE SIGHT

[76] Inventor: Huey P. Savage, 21902 Erie La., Lake Forest, Calif. 92630

[21] Appl. No.: 99,519

[22] Filed: Jul. 30, 1993

[51] Int. Cl.[5] ..... F41G 1/467

[52] U.S. Cl. ..... 33/265; 124/87

[58] Field of Search ..... 33/265, 233; 124/87, 124/88, 89, 90

[56] References Cited

U.S. PATENT DOCUMENTS

| | | | |
|---|---|---|---|
| 3,477,130 | 11/1969 | Egan | 33/265 |
| 3,696,517 | 10/1972 | Larson | 33/265 |
| 4,162,579 | 7/1979 | James | 33/265 |
| 4,494,313 | 1/1985 | Scott | 33/265 |
| 4,642,591 | 9/1985 | Montgomery | 33/265 |
| 4,965,938 | 10/1990 | Saunders | 33/265 |
| 4,967,478 | 11/1990 | Sherman | 33/265 |
| 5,025,565 | 6/1991 | Stenerson et al. | 33/265 |
| 5,107,596 | 4/1992 | Snyder | 33/265 |
| 5,220,907 | 6/1993 | Lonsdale | 124/87 |

*Primary Examiner*—William A. Cuchlinski, Jr.
*Assistant Examiner*—G. Bradley Bennett
*Attorney, Agent, or Firm*—Francis X. LoJacono

[57] ABSTRACT

An archery bow torque sight that allows an archer to improve accuracy by overcoming or substantially reducing the twisting and/or turning motion of a bow about the hand grip when force is applied as the archer draws the bow to an anchor point. The torque bow sight includes an elongated support bracket having a front sight in which a first single sight line is vertically disposed and a rear sight in which a second single sight line is vertically disposed so as to be superimposed over the first monofilament. The second sight line must be equal to or greater than the diameter of the first sight line. A yardage indicator is mounted within a compartment defined as part of the housing of the front sight by means of an improved adjusting device.

27 Claims, 2 Drawing Sheets

ARCHERY BOW TORQUE SIGHT

BACKGROUND OF THE INVENTION

1. Field of the Invention

This invention relates to an archery bow sight and more particularly to an archery bow torque sight that allows the archer to improve accuracy by overcoming or substantially reducing the twisting and/or turning motion of a bow about the hand grip when force is applied as the archer draws the bow to an anchor point.

2. Description of the Prior Art

As is well known in the art, various problems and difficulties are encountered in providing suitable sighting means that allows the archer to overcome the twisting of the bow when force is being applied by the archer storing and releasing the energy. To shoot an arrow each bow must be held at arm length with one hand while the other hand and arm pull the bowstring from its resting position to its full draw (or desired) position. The force exerted on the bowstring by the archer is commonly referred to as the draw weight. Once the bowstring is in the full draw position, the bow must be held in a steady position while the arrow is aimed at a desired target and then released. The limiting factor on draw weight is the strength of the archer's back muscles and particularly the strength of the back muscles associated with the pulling arm and wrist. The longer it takes to properly sight the target in the full draw position the harder it becomes to prevent a twisting movement of the wrist from one side to the other. The bow twists to one side at the handle grip area which makes it much harder to align typical known archery bow sights to a target.

A variety of different types of sight devices have been developed for use with archery bows, more particularly concerning those bows that are used for hunting. Even though many improvements have been made in sight devices of the prior art, the twisting of the archer's wrist has not been seriously considered. Compound hunting bows are commonly provided with sight holes or other attaching points on the bow.

However, the most accurate of such prior art sighting devices employ both front and rear sight members which generally include provisions to compensate for the varying amounts of vertical drop or differing trajectories which occur when the selected targets are at different distances from the archer. Still there is a need for a sight device that includes means to assist the archer in controlling the torque of the bow when positioned in the full draw position just before the release of the arrow.

Many of the known sighting devices are impractical for hunting where not only the target distance must be rapidly brought into focus in sufficient time to adjust the positioning of the sight but the archer must be able to immediately recognize that the vertical alignment of the bow has not twisted to one side or the other of the target.

In U.S. Pat. No. 4,982,503 to Leo Land, there is disclosed an archery bow sight that attempts to reduce the cant in the use of a bow and which comprises front and rear horizontal and vertical cross-hair sets located within front and rear sights which are mounted on a support member attached to the bow.

There are several other patents that also disclose various types of front and rear sight elements for improved accuracy, which include the following: U.S. Pat. No. 4,162,579 to James; U.S. Pat. Nos. 4,417,403; 4,494,313 to Scot; U.S. Pat. No. 4,967,478 to B. G. Sherman; and U.S. Pat. No. 4,542,591 to Montgomery.

SUMMARY AND OBJECTS OF THE INVENTION

The preferred embodiment of the invention defines an improved archery bow sight that includes means to aid in preventing twisting of the bow as the archer draws the bow to an anchor point. Accordingly, the torque bow sight of the present invention is arranged to be mounted to an archery bow on the bow handle or grip portion. The torque sight comprises a front and rear sight housing mounted to a support bracket which is positioned substantially horizontal to the perpendicular bow handle, the front sight housing being located forward of the bow handle or riser and the rear sight being positioned rearwardly thereof. Both the front and rear sight housing include a fixed vertical sight line and the rear vertical sight line has, preferably, a slightly smaller diameter than that of the front vertical sight line. A plurality of vertically adjustable sight pins are also positioned within the front sight housing and are arranged for selectively sighting the proper distance to a target.

Accordingly, it is an important object of the present invention to provide an archery bow torque sight that allows the archer to easily overcome the problem of twisting of the bow to improve the accuracy of the flight of the arrow.

Another object of the present invention is to provide an archery bow torque slight that includes front and rear vertical sight lines so as to overcome or substantially reduce the twisting and/or turning motion of the bow about the axis of the bow handle that is generally caused by the movement of the archer's wrist as force is applied when drawing and anchoring the bow string in a firing position. The superposing of the two vertical sight lines allows the archer to simultaneously measure and correct the placement of the bow handle and the position of the grip with every shot.

Yet another object of the invention is to provide and improved bow torque slight that has a pair of monofilament vertical sight lines that allow the archer means to control the placement of the arrow on the horizontal plane and eliminate "left/right" shooting errors and inconsistencies when properly aligned.

A further object of the invention is to provide a torque sight of this character wherein the vertical sight lines are so designed as to allow easy viewing at arm length (full draw of the bow riser) and quick adjustment of the hand grip placement to assure consistently accurate shots every time.

Still another object of the present invention is to provide an improved bow torque sight that not only includes a means to overcome torquing but also includes a plurality of yardage sight pins that are threadably mounted on a pair of vertically juxtaposed threaded carriage members by means of a thumb nut. This arrangement allows the archer to adjust the yardage sight pins for alignment with one's fingers ana without the use of tools.

Yet another object of the invention is to provide a bow sight of this character wherein the sight markers or pins can be micro adjusted individually or adjusted in a group.

A still further object of the present invention is to provide an improved bow sight of this character that is relatively inexpensive to manufacture, and that is easy to service and maintain.

It is still a further object of the invention to provide an improved bow sight of this character that is simple yet rugged in construction.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

With the above and related objects in view, the invention consists in the details of construction and combination of parts, as will be more fully understood from the following description, when read in conjunction with the accompanying drawings and numbered parts.

DESCRIPTION OF THE PREFERRED EMBODIMENT

Figure 1:
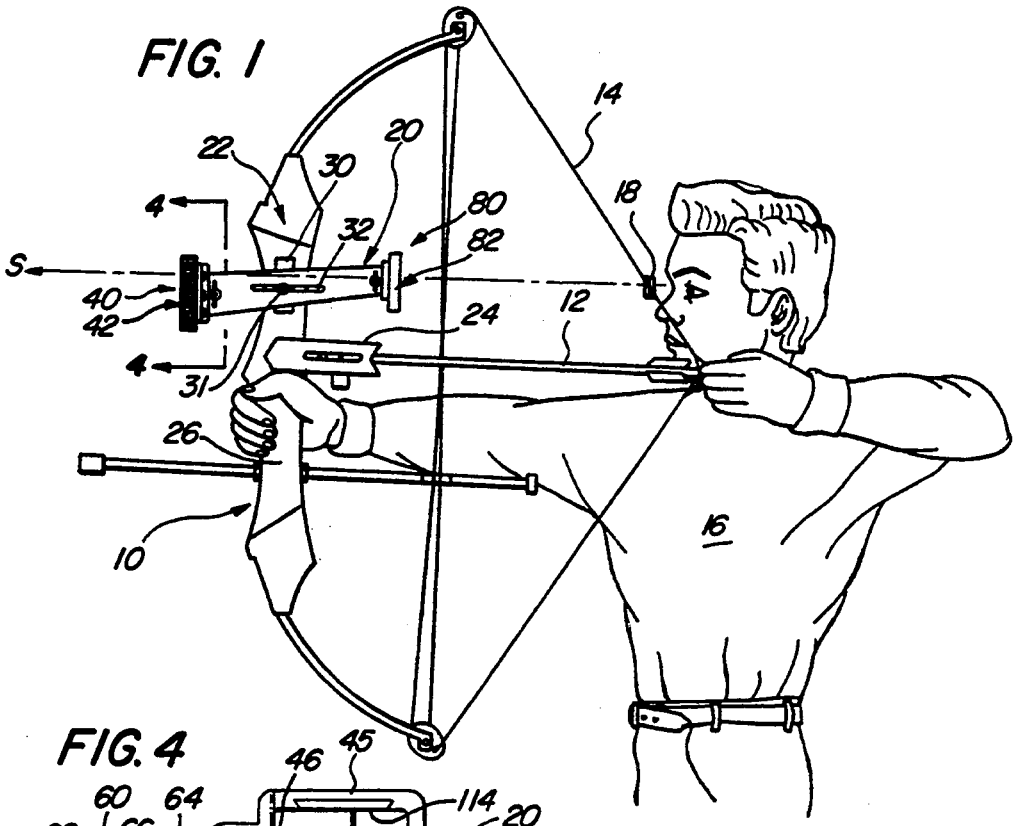
FIG. 1 is a pictorial view illustrating an archer in a shooting position with the bow in a fully drawn position and sighting the target through an eye piece on the bow string in conjunction with the torque sight of the present invention.

Referring more particularly to FIG. 1, there is shown a typical archery bow, generally indicated at 10, having a suitable arrow 12 mounted thereon. Bow 10 is illustrated in a fully drawn mode with a bowstring 14 anchored in a firing position by an archer, indicated at 16. The archer is shown sighting (dash line S) through a suitable archery peep sight 18 that is attached to bowstring 14 to align peep sight 18 with the present invention, that being a bow torque sight, designated generally by numeral 20. The bow torque sight is adjustably mounted to the handle or riser member 22 of bow 10 and is positioned above an arrow rest device 24 and hand grip section 26 of riser 22. Further, torque sight 20 is shown mounted on the left side of riser 22 for a left-hand person but is also adapted to be easily rearranged on the opposite side of riser 22 for a right-hand person as will ben readily understood in the following detailed description of the bow torque sight.

Bow torque sight 20 is mounted to riser 22 by securing means that is defined by a mounting plate 30 which is affixed to the riser, and a bolt member 31 that is positioned through a substantially horizontal slot 32 formed in the support bracket 34 of torque sight 20. The bolt is threadably secured to mounting plate 30, seen in FIG. 1. Support bracket 34 is more clearly illustrated in FIG. 2, which shows the right side of the torque sight, wherein bracket 34 is provided with a front substantially vertical slot 36 and a rear substantially vertical slot 38. A front sight 40 is adjustably mounted to front slot 36 and a rear sight 42 is mounted to rear slot 38.

Figure 4:
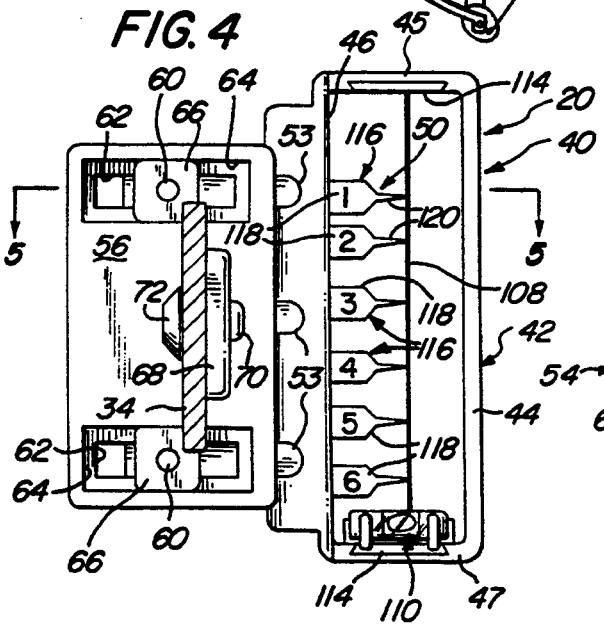
FIG. 4 is an enlarged cross-sectional view taken substantially along line 4—4 of FIG. 2.
Figure 5:
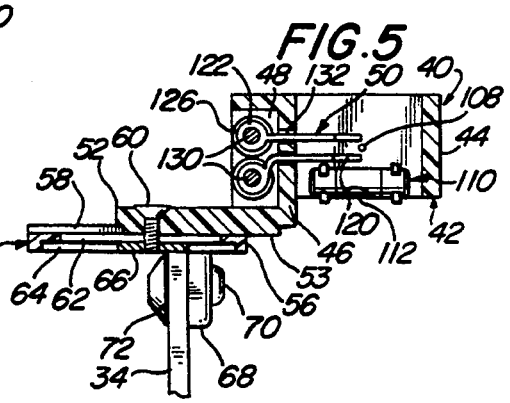
FIG. 5 is a cross-sectional view taken substantially along line 5—5 of FIG. 4.
Figure 3:
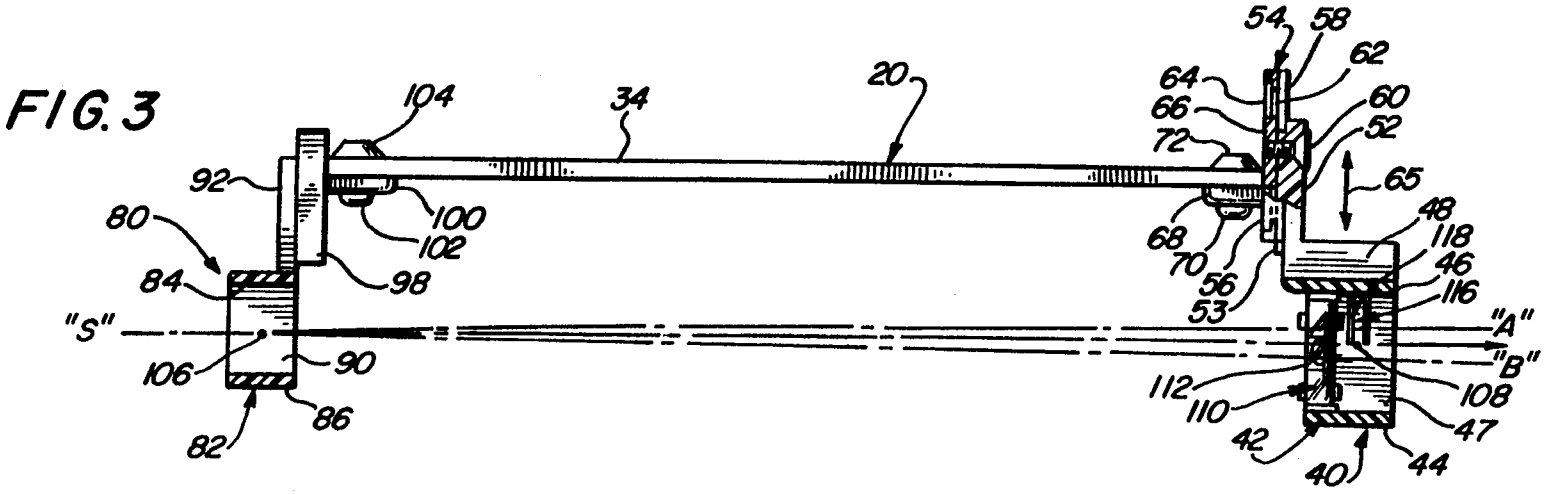
FIG. 3 is a top plan view of that seen in FIG. 2 with a portion of the front and rear sight housings broken away.
Figure 2:
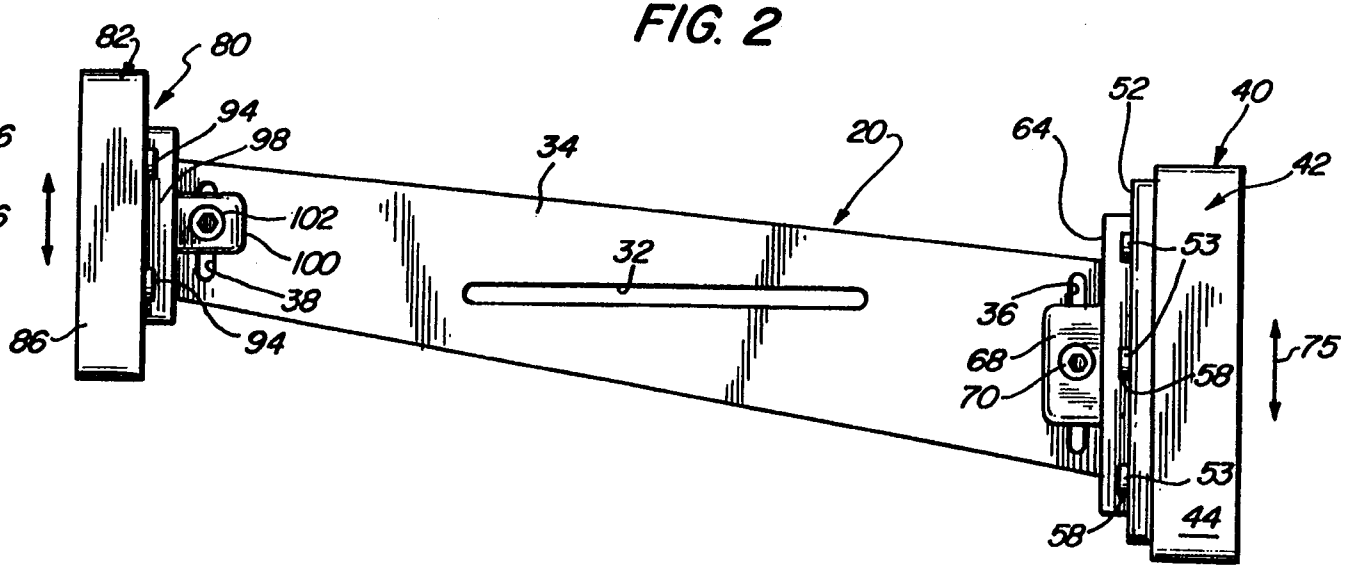
FIG. 2 is an enlarged side-elevational view of the opposite side shown in FIG. 1.

Front sight 40 comprises a substantially rectangular housing 42 defined by a first side wall 44, a second side wall 46, and top and bottom walls 45 and 47 respectively, said second side wall 46 being formed so as to define a compartment 48 in which is mounted an adjustable yardage indicator means, designated at 50. An enlarged flange member 52 is integrally formed as part of compartment 48 and extends to the left thereof. Flange 52 is formed with a plurality of horizontally placed guide bars 53, whereby housing 42 is adjustably mounted to a front housing bracket 54 defined by a mounting plate 56 which is formed having a plurality of horizontal grooves 58 that correspond to guide bars 53 so that housing 42 can be horizontally adjusted inwardly and outwardly thereon. A pair of mounting screws 60 are supported in flange member 52, each screw being received through respective aligned horizontal slots 62 which are formed in an enlarged slot 64. A nut 66 is positioned in each enlarged slot 64 whereby screws 60 are respectively attached, as illustrated in FIGS. 3, 4 and 5. This arrangement provides a means for adjusting housing 42 horizontally, as indicated by arrow 65 in FIG. 3. Flange member 52 is also formed having a rearwardly positioned ear member 68 which is adjustably attached to support bracket 34 by an adjustable fastening means that is defined by screw 70 mounted through ear member 68 and vertical slot 36 and secured by nut 72, as shown in FIG. 2. This arrangement allows housing 42 to be adjusted perpendicularly with respect to support bracket 34, as indicated by arrow 75.

Figure 7:
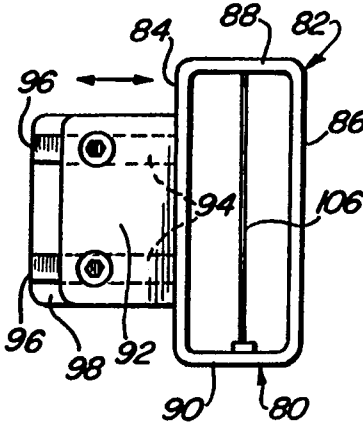
FIG. 7 is a rear view of the rear sight housing having a single vertical sight line.

A rear sight, generally indicated at 80, is shown as being adjustably mounted to rear vertical slot 38 of support bracket 34. Rear sight 80 is defined by housing 82 that comprises side walls 84 and 86, and top and bottom walls 88 and 90 respectively. An extended mounting flange member 92 is integrally formed with side wall 84 and is provided with a pair of horizontal guide bars 94 that are slidably received in a pair of respective aligned grooves 96 formed in rear housing bracket 98, as illustrated in FIGS. 2 and 7. Housing bracket 98 is formed with an extended ear member 100 which is adapted to receive screw 102 which projects through slot 38 and is secured therein by nut 104. In FIG. 7, a single vertical sight line 106 defined by a monofilament, which will also be referred to as the rear sight line, is shown centrally mounted within rear sight housing 82 wherein one end is secured in top wall 88 and the opposite end is secured to the bottom wall 90.

Referring now to FIGS. 3, 4, 5 and 6, there is shown the novel structure of the front sight 40 that includes a single vertical sight line 108, defined by a monofilament, which will also be referred to as the front sight line that is centrally mounted within front sight housing 42. The upper end of front sight line 108 is secured to top wall 45 and the lower end is secured to bottom wall 47. The monofilament of sight line 108 is formed having a diameter equal to or greater than that of the monofilament that defines the rear sight line 106. This arrangement assures that front sight line 108 will always be in view of the archer during the sighting of a target. When sighting a target, particularly a moving one, front sight line 108 can be viewed at all times for accurate positioning on the target as the archer sights the target through peep sight 18. If bow 10 or more particularly riser 22 is caused to torque in one direction or the other by movement of the archer's wrist or forearm, the rear sight line 106 will be viewed to one side or the other of the front sight line 108. In FIG. 3 target line "S" is shown as a straight line that intersects both the rear and front sight lines. This is the ideal target line. However, when torque occurs, as mentioned above, the target line will take a direction indicated by either line "A" or "B".

Front sight housing 42 is also provided with a horizontal level means 110 that indicates the vertical position of bow torque sight 20. Level means 110 comprises a suitable level, such as a bubble type level 112, that is removably mounted to housing 42. Top wall 45 and lower wall 47 are each provided with a recess 114, wherein level 112 can be selectively positioned, as illustrated in FIGS. 3, 4 and 5, so as to set the vertical position of bow 10 with respect to the longitudinal axis of the archer's arm when bowstring 14 is fully drawn, as seen in FIG. 1.

Figure 6:
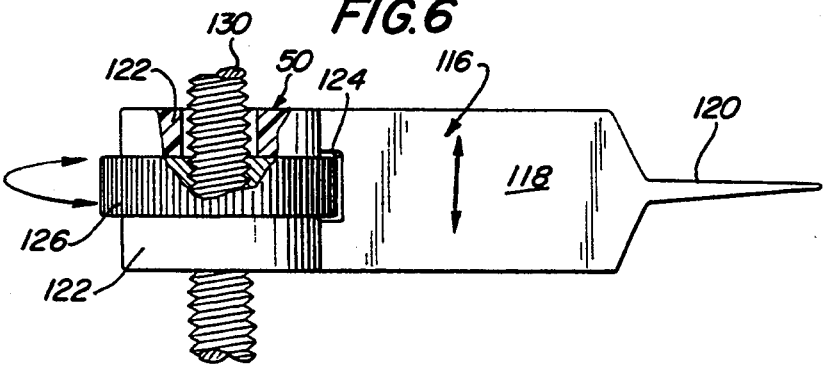
FIG. 6 is an enlarged view of one of the yardage indicating pins mounted to the threaded carriage member.

Referring now to the adjustable yardage indicator means 50, which is shown in FIGS. 3, 4, 5 and 6, it comprises a plurality of yardage markers or pins, indicated at 116. Each marker is shown having indicia or markings printed thereon which indicate distance in yardage from the archer to the target. The markers are marked starting with the numeral 1 through 6, wherein numeral 1 represents ten (10) yards, 2 represents twenty (20) yards and so on up to sixty (60) yards. As more clearly shown in FIG. 6, each marker 116 comprises a substantially flat pointer member 118 having a needle nose 120 when adjustably mounted in compartment 48 and is positioned adjacent the left side of front sight line 108. The opposite end of marker 116 is formed having a pair of spaced apart mounting ring members 122 which define a slot 124 adapted to receive a thumb nut 126 that is adjustably mounted to one of a pair of threaded carriage pins 130 which are fixedly mounted in compartment 48. Mounting rings 122 straddle thumb nut 126 so as to be vertically adjusted up or down on the respective carriage pin 130 as might be required by the archer. For ease of adjusting the yardage markers, the pointers thereof are alternatively mounted forwardly and rearwardly of front sight line 108, as illustrated in FIG. 6. To accomplish this arrangement side wall 46 of housing 42 is formed having a pair of parallel vertical slots 132, as illustrated in FIG. 5.

Accurate marksmanship in archery is the result of many factors. The most important factors are consistency in form and style of the archer, and a bow sight that can be accurately adjusted to the form and style of the archer. The present torque sight allows an archer to measure and correct the placement of the bow handle and the position of the grip with every shot.

The unique construction of the vertical sight lines allows an archer to correct and control any twisting or torquing motions that are natural when gripping the bow handle (riser). The two vertical sight lines are simply positioned by the archer so that the rear sight is superimposed over the front sight as the archer is sighting through the peep sight mounted on the bowstring.

Another important element is the novel adjusting arrangement of the yardage markers. The yardage markers are also used as elevation markers which, when properly used, allow the archer sighting through them to adjust the elevation position of the bow based on the distance to the target. When properly used in combination, the vertical sight lines and the horizontal markers allow an archer to properly coordinate his X and r axis with every shot.

It may thus be seen that the objects of the present invention set forth herein, as well as those made apparent from the foregoing description, are efficiently attained, While the preferred embodiment of the invention has been set forth for purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What I claim is:

1. An archery torque bow sight for attachment to the riser of an archery bow having a bowstring and a peep sight mounted on the bowstring, said torque bow sight comprising:

an elongated support bracket for adjustable attachment to the riser of an archery bow and having front and rear mounting ends;

front sight means defined by a front housing having a first side wall, a second side wall having a pair of spaced-apart vertical parallel slots formed therein, and a top and bottom wall;

front mounting means for adjustably mounting said front housing to said front mounting end of said bracket both vertically and horizontally with respect to said support bracket;

rear sight means defined by a rear housing having a first and a second side wall, and a top and bottom wall;

rear mounting means for adjustably mounting said rear housing to said rear mounting end of said bracket both vertically and horizontally with respect to said support bracket;

a front vertical sight line member centrally mounted within said front housing;

a rear vertical sight line member centrally mounted within said rear housing and having a diameter equal to or less than said front vertical sight line member.

2. An archery torque bow sight as recited in claim 1, wherein said first side wall is formed having a compartment, and wherein a yardage indicator means is operably mounted in said compartment.

3. An archery torque bow sight as recited in claim 2, wherein said front mounting means comprises:

a front housing bracket mounted for vertical movement within a vertical slot formed in said front mounting end of said support bracket for vertical adjustment thereon;

a flange member integrally formed with said compartment and extending outwardly therefrom, and attached to said front housing bracket, whereby said front sight means is horizontally adjustable thereon; and a front horizontal adjusting means for moving said front sight means horizontally with respect to said support bracket.

4. An archery torque bow sight as recited in claim 3, wherein said horizontal adjusting means comprises:

a plurality of vertically spaced horizontal bar members integrally formed in said flange member;

a corresponding number of horizontally spaced grooves formed in said front housing bracket, whereby said bar members are slidably received in said corresponding grooves; and means for fixedly attaching said flange member to said front housing bracket.

5. An archery torque bow sight as recited in claim 4, wherein said rear mounting means for adjustably mounting said rear housing comprises:

a rear housing bracket mounted for vertical movement within a vertical slot formed in said rear mounting end of said support bracket for vertical adjustment thereon;

a flange member integrally formed with said rear housing and extending outwardly therefrom for attachment to said front housing bracket, whereby said rear sight means is horizontally adjustable thereon; and a rear adjusting means for adjusting said rear sight means horizontally with respect to said support bracket.

6. An archery torque bow sight as recited in claim 5, wherein said horizontal adjusting means of said rear housing comprises:

a plurality of horizontally spaced bar members integrally formed in said flange member;

a corresponding number of horizontally spaced grooves formed in said rear housing bracket, whereby said bar members are slidably received in said corresponding grooves; and means for fixedly attaching said flange member to said rear housing bracket.

7. An archery torque bow sight as recited in claim 6, wherein said yardage indicator means comprises:

a plurality of yardage markers mounted within said compartment for vertical adjustment in said front housing;

means for vertically adjusting said yardage markers positioned in said compartment.

8. An archery torque bow sight as recited in claim 7, wherein each yardage marker comprises:

a substantially flat pointer having a needle nose formed on one end thereof so as to extend through one of said vertical slots formed in said second side wall, whereby said needle nose is positioned adjacent the left side of said front sight line, and a pair of spaced-apart mounting ring members formed on the opposite side of said yardage marker and positioned in said compartment.

9. An archery torque bow sight as recited in claim 8, wherein said means for vertically adjusting said yardage markers positioned in said compartment comprises:

a slot defined by said spaced-apart mounting ring members;

at least one threaded carriage pin fixedly mounted vertically in said compartment to receive said mounting ring members;

a thumb nut threadably mounted on said carriage pin, said thumb nut being positioned within said slot defined by said mounting ring members, whereby said yardage markers are selectively positioned along said carriage pin.

10. An archery torque bow sight as recited in claim 9, including:

a pair of carriage pins mounted in said compartment in alignment with said parallel slots formed in said second side wall thereof;

said pointers of said yardage markers being alternatively positioned forwardly and rearwardly of said front sight line.

11. An archery torque bow sight as recited in claim 10, including a level indicating means mounted on said front housing front sight means.

12. For use with an archery bow having a bowstring and a peep sight mounted on the bowstring, a torque bow sight for attachment to a riser of an archery bow, said torque bow sight including in combination:

a peep sight mounted to the bowstring of the archery bow;

an elongated support bracket for attachment to the riser of the archery bow above and having front and rear mounting ends;

front sight means defined by a front housing having a first side wall, a second side wall having a pair of spaced apart vertical parallel slots formed therein, and top and bottom walls;

front mounting means for adjustably mounting said front housing to said front mounting end of said bracket both vertically and horizontally with respect to said support bracket;

rear sight means defined by a rear housing having a first and a second side wall, and a top and bottom wall;

rear mounting means for adjustably mounting said rear housing to said rear mounting end of said bracket both vertically and horizontally with respect to said support bracket and said front housing;

a front vertical sight line member centrally mounted within said front housing;

a rear vertical sight line member centrally mounted within said rear housing and having a diameter equal to or less than said front vertical sight line member, whereby said front vertical sight line and said rear vertical sight line are arranged to be sighted in a superimposed positioned on a target through said peep sight when the bowstring is fully drawn by the archer.

13. The combination as recited in claim 12, wherein said first side wall is formed having a compartment, and wherein a yardage indicator means is operably mounted in said compartment.

14. The combination as recited in claim 13, wherein said front mounting means comprises:

a front housing bracket mounted for vertical movement within a vertical slot formed in said front mounting end of said support bracket for vertical adjustment thereon;

a flange member integrally formed with said compartment and extending outwardly therefrom and attached to said front housing bracket, whereby said front sight means is horizontally adjustable thereon; and a front horizontal adjusting means for moving said front sight means horizontally with respect to said support bracket.

15. The combination as recited in claim 14, wherein said horizontal adjusting means comprises:

a plurality of vertically spaced horizontal bar members integrally formed in said flange member;

a corresponding number of horizontally spaced grooves formed in said front housing bracket, whereby said bar members are slidably received in said corresponding grooves; and means for fixedly attaching said flange member to said front housing bracket.

16. The combination as recited in claim 15, wherein said rear mounting means for adjustably mounting said rear housing comprises:

a rear housing bracket mounted for vertical movement within a vertical slot formed in said rear mounting end of said support bracket for vertical adjustment thereon;

a flange member integrally formed with said rear housing and extending outwardly therefrom for attached to said front housing bracket, whereby said rear sight means is horizontally adjustable thereon; and a rear adjusting means for adjusting said rear sight means horizontally with respect to said support bracket.

17. The combination as recited in claim 16, wherein said yardage indicator means comprises:

a plurality of yardage markers mounted within said compartment for vertical adjustment in said front housing;

means for vertically adjusting said yardage markers positioned in said compartment.

18. The combination as recited in claim 17, wherein each yardage marker comprises:

a substantially flat pointer member having a needle nose formed on one end thereof so as to extend through one of said vertical slots formed in said second side wall, whereby said needle nose is positioned adjacent the left side of said front sight line; and a pair of spaced apart mounting ring members formed on the opposite side of said pointer member and positioned in said compartment.

19. The combination as recited in claim 18, wherein said means for vertically adjusting said yardage markers positioned in said compartment comprises:

a slot defined by said spaced-apart mounting ring members;

at least one threaded carriage pin fixedly mounted vertically in said compartment to receive said mounting ring members;

a thumb nut threadably mounted on said carriage pin, said thumb nut being positioned within said slot defined by said mounting ring members, whereby said yardage markers are selectively positioned along said carriage pin.

20. The combination as recited in claim 19, including:

a pair of carriage pins mounted in said compartment in alignment with said parallel slots formed in said second side wall thereof, whereby said pointer members are alternatively positioned forwardly and rearwardly of said front sight line, so that said front sight line is positioned therebetween.

21. The combination as recited in claim 20, including a level indicating means mounted on said front housing of said front sight means.

22. An improved archery bow sight including a yardage indicator adapted to be mounted to the riser of an archery bow, and having a bowstring and a peep sight, said improved bow sight comprising:

an elongated support bracket for adjustable attachment to the riser of an archery bow and having front and rear mounting ends;

front sight means defined by a front housing having a first side wall, a second side wall having a pair of spaced-apart vertical parallel slots formed therein, and a top and bottom wall, wherein said second side wall is defined by a compartment;

a yardage indicator mounted in said compartment;

means for selectively adjusting said yardage indicator;

front mounting means for adjustably mounting said front housing to said front mounting end of said bracket both vertically and horizontally with respect to said support bracket;

rear sight means defined by a rear housing having a first and a second side wall, and a top and bottom wall;

rear mounting means for adjustably mounting said rear housing to said rear mounting end of said bracket both vertically and horizontally with respect to said support bracket.

23. An improved bow sight as recited in claim 22, wherein said yardage indicator means comprises:

a plurality of yardage markers mounted within said compartment for vertical adjustment in said front housing; and means for vertically adjusting said yardage markers positioned in said compartment.

24. An improved archery bow sight as recited in claim 23, wherein each yardage marker comprises:

a substantially flat pointer having a needle nose formed on one end thereof so as to extend through one of said vertical slots formed in said second side wall, whereby said needle nose is positioned adjacent the left side of said front sight line;

a pair of spaced-apart mounting ring members formed on the opposite side of said pointer and positioned in said compartment to extend outwardly through said slots in said second wall and into said front housing.

25. An improved archery bow sight as recited in claim 24, wherein said means for vertically adjusting said yardage markers positioned in said compartment comprises:

a slot defined by said spaced-apart mounting ring members;

at least one threaded carriage pin fixedly mounted vertically in said compartment to receive said mounting ring members; and a thumb nut threadably mounted on said carriage pin, said thumb nut being positioned within said slot defined by said mounting ring members, whereby said yardage markers are selectively positioned along said carriage pin.

26. An improved archery bow sight as recited in claim 25, including:

a pair of carriage pins mounted in said compartment adjacent to said parallel slots formed in said second side wall thereof;

said pointers of said yardage markers being alternatively positioned forwardly and rearwardly of a front sight line mounted in said front housing.

27. An archery torque bow sight as recited in claim 26, including a level indicating means mounted on said front housing.

* * * * *